US005388499A

United States Patent [19]

Szyndlar

[11] Patent Number: 5,388,499

[45] Date of Patent: Feb. 14, 1995

[54] CARTRIDGE FOR EXPLOSIVELY OPERATED INDUSTRIAL TOOLS

[75] Inventor: Janusz Szyndlar, Unionville, Canada

[73] Assignee: The Whitaker Corporation, Wilmington, Del.

[21] Appl. No.: 213,432

[22] Filed: Mar. 15, 1994

[51] Int. Cl.[6] ..... C06D 5/00

[52] U.S. Cl. ..... 89/1.14; 60/632; 102/464; 102/469; 102/531; 227/10

[58] Field of Search ..... 102/430, 464, 466, 467, 102/469, 470, 530, 531; 60/632; 227/9, 10, 11; 89/1.14

[56] References Cited

U.S. PATENT DOCUMENTS

| | | | |
|---|---|---|---|
| 3,007,409 | 11/1961 | Broske . | |
| 3,026,603 | 3/1962 | Metzger | 102/466 |
| 3,139,030 | 6/1964 | Yamamoto | 102/530 |
| 3,155,039 | 11/1964 | Broske . | |
| 3,343,294 | 9/1967 | Wahl | 227/9 |
| 3,363,564 | 1/1968 | Gawlick et al. | 102/470 |
| 3,855,900 | 12/1974 | Barr et al. | 89/159 |
| 3,861,308 | 4/1975 | Grandy | 102/430 |
| 4,913,055 | 4/1990 | Goto et al. | 102/470 |
| 5,905,603 | 3/1990 | McBain | 102/530 |

FOREIGN PATENT DOCUMENTS

| | | | |
|---|---|---|---|
| 338397 | 10/1989 | European Pat. Off. | 102/204 |
| 1371255 | 7/1964 | France | 102/466 |
| 81971 | 7/1895 | Germany | 102/470 |
| 11356 | 8/1956 | Germany | 102/464 |
| 301423 | 4/1932 | Italy | 102/204 |
| 1169 | 6/1889 | Switzerland | 102/470 |
| 724 | of 1883 | United Kingdom | 102/470 |
| 1431 | of 1883 | United Kingdom | 102/470 |
| 994846 | 6/1965 | United Kingdom | 102/531 |

OTHER PUBLICATIONS

AMP Troubleshooting Guide for AMPACT Taps and Application Tooling.

*Primary Examiner*—Harold J. Tudor

[57] ABSTRACT

A cartridge (24) for explosively operated industrial tools is disclosed. The tool (10) is of the type that has a piercer pin (46) that pierces through a surface of the cartridge during assembly of the cartridge within the tool. Then, upon firing of the cartridge, the residual gases (72) formed by the explosion are vented to the atmosphere by moving the piercer pin out of the pierced opening (70). The present cartridge includes a depression (64) in a surface of the base (62) that is in alignment with the piercer pin. There is a relatively thin section (66) of the base left at the bottom of the depression. The thin section is sized so that when it is unsupported, as for example when a defective piercer pin is used, it will fracture under the forces of the exploding powder (38) and the residual gases formed by the explosion will be vented through the fracture and into the atmosphere.

11 Claims, 3 Drawing Sheets

CARTRIDGE FOR EXPLOSIVELY OPERATED INDUSTRIAL TOOLS

The present invention relates to cartridges for explosively operated industrial tools of the type having a piercer pin that pierces the casing of the cartridge for venting gasses after ignition of the explosive powder.

BACKGROUND OF THE INVENTION

Explosively operated industrial tools utilizing cartridges having explosive powder and a primer for detonating the powder are disclosed in U.S. Pat. Nos. 3,007,409 and 3,155,039. Both of these patents disclose cartridges that include a gas check member that has one end adjacent the explosive powder and the other end facing outwardly with a detonator primer therein. An opening communicates between the primer and the explosive powder. A ram is arranged so that it can be made to slide into the open end of the cartridge, strike the primer, thereby igniting the explosive powder which then forces the ram outwardly to perform the desired work operation. The tool includes a piercer pin that pierces through the shell casing and into the chamber holding the explosive powder. After ignition, the gases from the explosion are trapped within the cartridge because the gas check remains within the open end of the cartridge blocking possible escape. To release these trapped gases the piercer pin is moved away from the cartridge a small amount, thereby allowing the gases to escape through the pierced opening in the shell casing. When the tool has been in use for a long time, the piercer pin may become worn, broken, or otherwise damaged and may not pierce completely through the shell casing. When this occurs the cartridge may remain under pressure after it is removed from the tool.

What is needed is a cartridge that automatically undergoes a controlled fracture during ignition only when the piercer pin is badly damaged so that the gases can escape through the fracture by the broken piercer pin. However, the cartridge must retain the gases when the piercer pin is normal and has completely pierced through the shell casing.

SUMMARY OF THE INVENTION

A cartridge is disclosed for use in an explosively operated industrial tool of the type having a body with a chamber therein for receiving the cartridge. A breach cap is fitted over the body enclosing one end of the chamber. The breach cap has a piercer pin projecting therefrom into the chamber for piercer through an end of the cartridge to release gases contained therein. The cartridge includes an elongated shell open at one end and having a base at the opposite end. A gas check is positioned in the shell between the open end and the base. An explosive powder is contained in a powder chamber within the shell between the gas check and the base. A depression is arranged in the base forming a relatively thin section therein adjacent to and in alignment with the piercer pin. The cartridge is arranged so that when the piercer pin does not pierce completely through the thin section, the thin section will fracture upon ignition of the explosive powder allowing expanding gases to escape through the fracture.

DESCRIPTION OF THE PREFERRED EMBODIMENT

Figure 1:
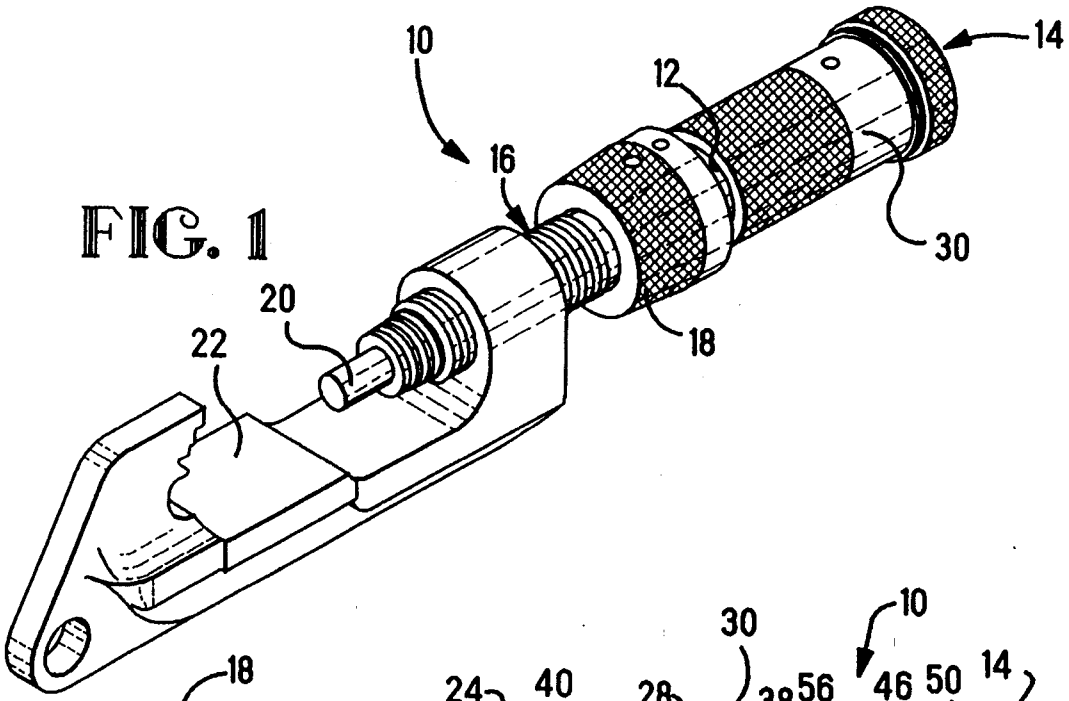
FIG. 1 is an isometric view of an industrial tool that utilizes an explosive cartridge incorporating the teachings of the present invention.
Figure 2:
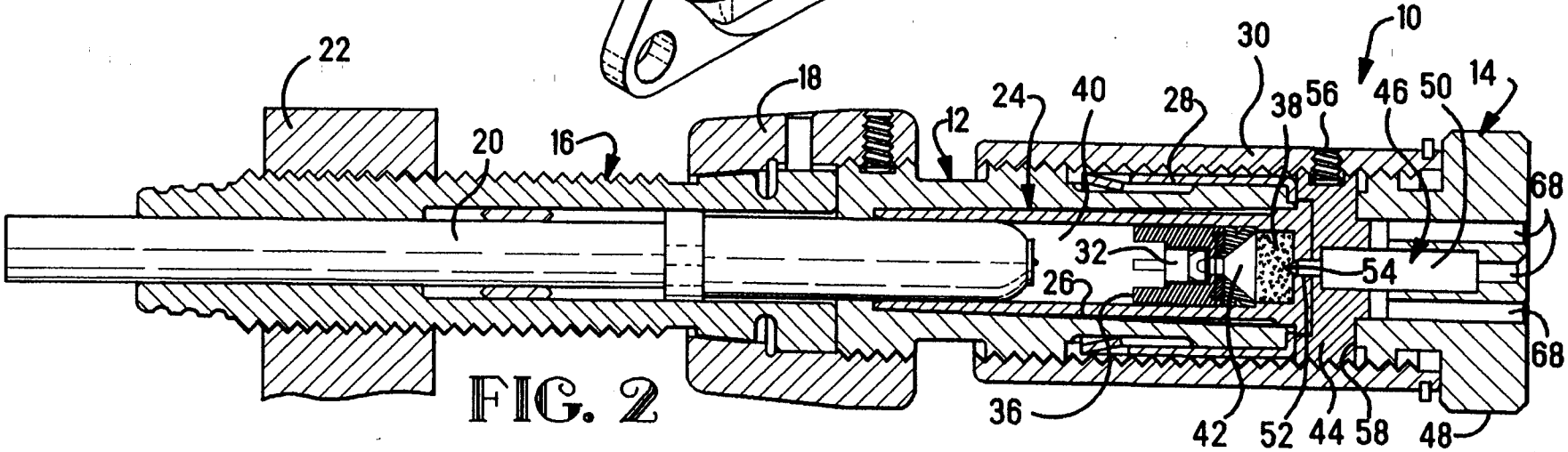
FIG. 2 is a partial cross-sectional view taken along the longitudinal axis of the tool shown in FIG. 1.
Figure 7:
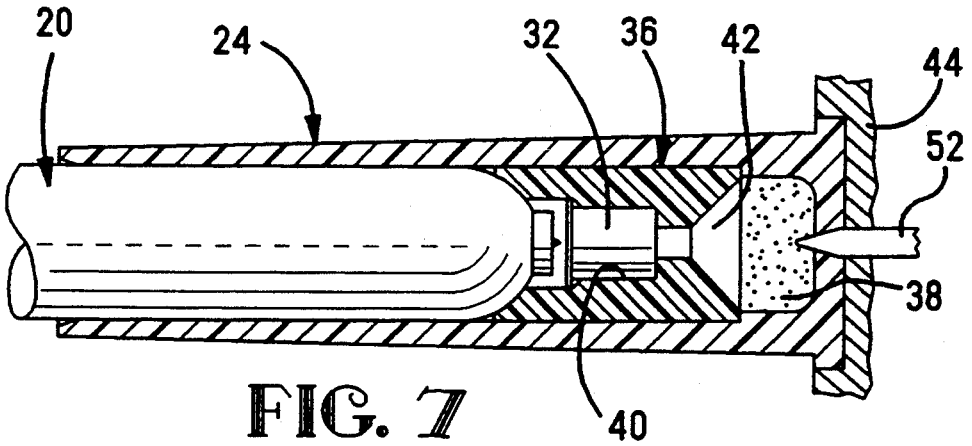
FIG. 7, 8, and 9 are cross-sectional views of the explosive cartridge shown in FIG. 2 showing the ram and the gas check member in positions corresponding to various stages of operation.

There is shown in FIGS. 1 and 2 an explosively operated industrial tool 10 having a breech 12, a breech nut assembly 14 removably mounted to one end of the breech 12, a barrel 16 attached to the other end of the breech 12 by means of a coupling 18, and a ram 20 which is positioned and slidable within both the barrel 16 and the breech 12. A platform 22 is secured to the end of the barrel 16 opposite the coupling 18 by means of screw threads. The platform 22 holds a work piece (not shown) for work to be performed thereon by the ram 20 as it is driven forward by an expanding gas generated by detonating a cartridge 24. As shown in FIG. 2 the breech 12 includes a chamber 26 which receives the cartridge 24 in one end and the ram 20 in the other end. A cartridge ejector 28 is disposed around the breech 12. The cartridge 24 includes a gas check member 36 having a primer 32 pressed into an outwardly facing opening 40 therein and a charge of explosive powder 38 arranged in a cavity in the end of the cartridge, as shown in FIGS. 2 and 7. Another opening 42 in the gas check member 36 is in communication with both the primer 32 and the powder 38.

The breech nut assembly 14 includes a sleeve 30 that is threadingly attached to the breech 12 and provides a threaded aperture for receiving a knurled member 48. The assembly 14 further includes an end cap 44 threaded into the sleeve 30 and a piercer pin 46. The knurled member 48 is arranged for setting the piercer pin and serving as a backup to the end cap. The piercer pin 46 includes a shank 50 that is press fit in a hole in the knurled member 48, as shown in FIG. 2, and a necked down tip 52 having tapered walls that terminate in a radius 54 for a purpose that will be explained below. The end cap 44 includes a bore and counter bore sized to loosely receive the tip and shank, respectively, of the piercer pin 46. The end cap 44 is threaded into the sleeve 30 until it is in the position shown in FIG. 2 and is then secured in this position by means of a set screw 56 threaded into the side of the sleeve 30. When the breech nut assembly 14 is assembled to the breech 12, it is threaded thereon until the end cap 44 abuts the end of the cartridge ejector 28, as shown in FIG. 2. The knurled member 48 has a shoulder 58 that engages the end cap 44 and provides support thereto during operation of the tool. In this position, the knurled member 48 also holds the shank 46 in the counterbore in the end cap 44 so that the tip 52 extends well past the end cap toward the cartridge 24, as best seen in FIG. 2

Figure 3A:
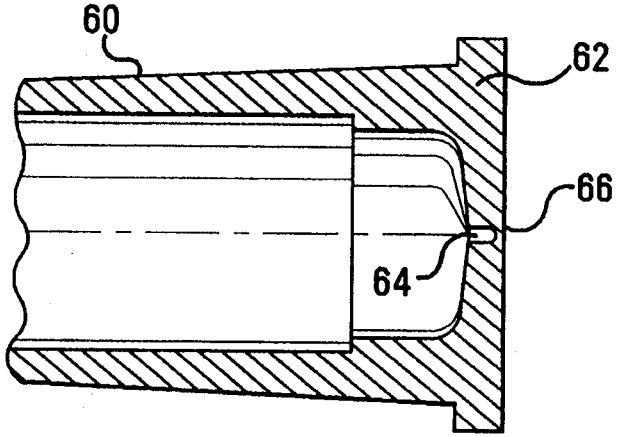
FIG. 3A is a view of a portion of the cartridge shell shown in FIG. 3 showing alternate embodiment.
Figure 3:
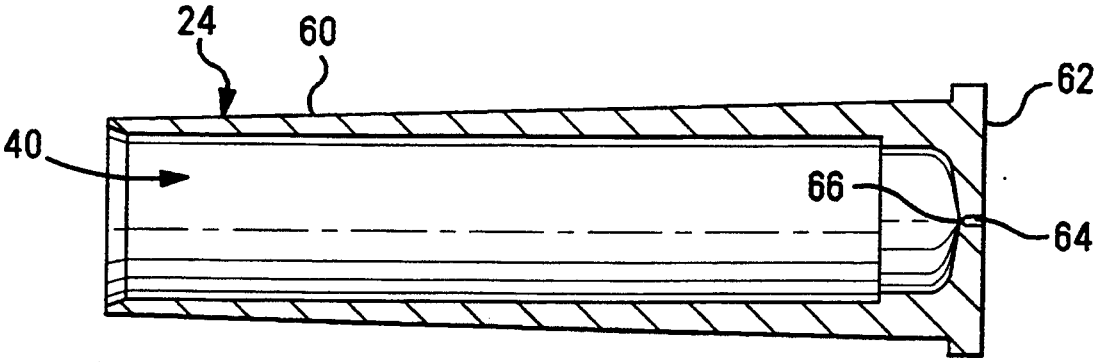
FIG. 3 is a cross-sectional view of a cartridge shell incorporating the teachings of the present invention, the view being taken along its longitudinal axis.

The cartridge 24 has a shell 60 made of a suitable plastic material and having a closed base 62, as shown in FIG. 3. A depression 64 is formed in the base 62 so that a relatively thin section 66 is formed in the base. This depression 64 may be formed in either the inside surface or the outside surface of the base 62. In the first case the thin section 66 would be flush with the outside surface of the base, as show in FIG. 3A, while in the second case it would be as shown in FIG. 3. The depression has a width of up to about 0.100 inch, however, its width is preferably about 0.028 inch. The depth of the depression is arranged so that the thin section 66 has a thickness of from about 0.003 inch to about 0.025 inch and, preferably from about 0.005 inch to about 0.015 inch. The actual thickness of the thin section 66 may vary depending on the specific plastic material used to make the shell 60. The important requirement is that when the thin section is unsupported it must fracture under the force and heat of the exploding powder 38 when the tool 10 is operated so that expanding gases can escape through the fracture, as will be explained below.

Figure 4:
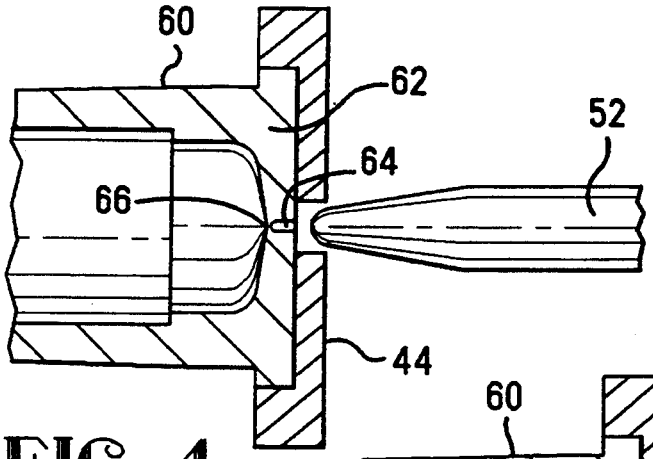
FIGS. 4 and 5 are cross-sectional views of a portion of the base of the cartridge shown in FIG. 2 showing the piercer pin in different positions.
Figure 5:
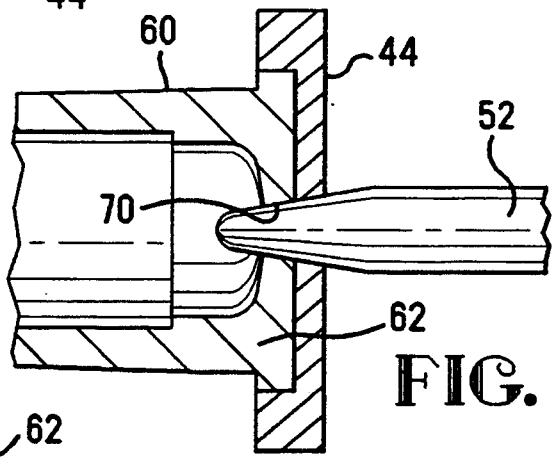

In operation, a fresh cartridge 24 is inserted into the breech 12 and the breech nut assembly 14 threaded into place. This causes the tip 52 of the piercer pin 46 to engage the depression 64 in the base 62 of cartridge, as shown in FIG. 4, and to pierce completely through the base 62 so that the tip 52 is extending into the interior chamber of the cartridge, as shown in FIG. 5. In this position the tip 52 has formed an opening 70 in the base but the tapered walls of the tip are wedged therein to form a tight seal. A work piece is then inserted in the tool 10 and the barrel 16 screwed into the platform 22 to bring the tip of the ram 20 into engagement with the work piece. The relative positions of the ram 20, gas check 36, and cartridge 24 prior to firing are shown in FIG. 7. The end of the knurled member 48 is then struck sharply by a hammer. This causes the breech nut assembly to force the cartridge toward the ram and detonate the primer 32. The explosive powder 38 is ignited by the exploding primer causing expanding gases to drive the ram 20 forcefully forward against the work piece to perform the desired work operation.

Figure 8:
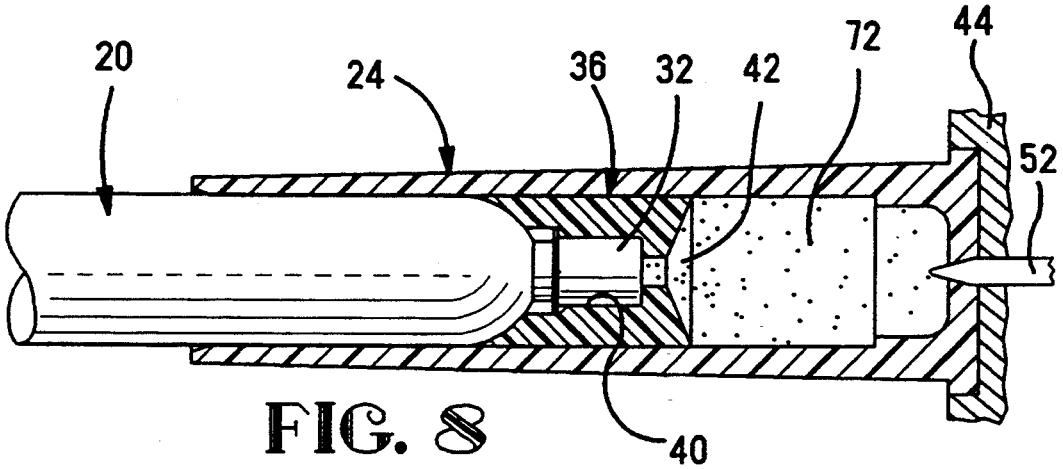
Figure 9:
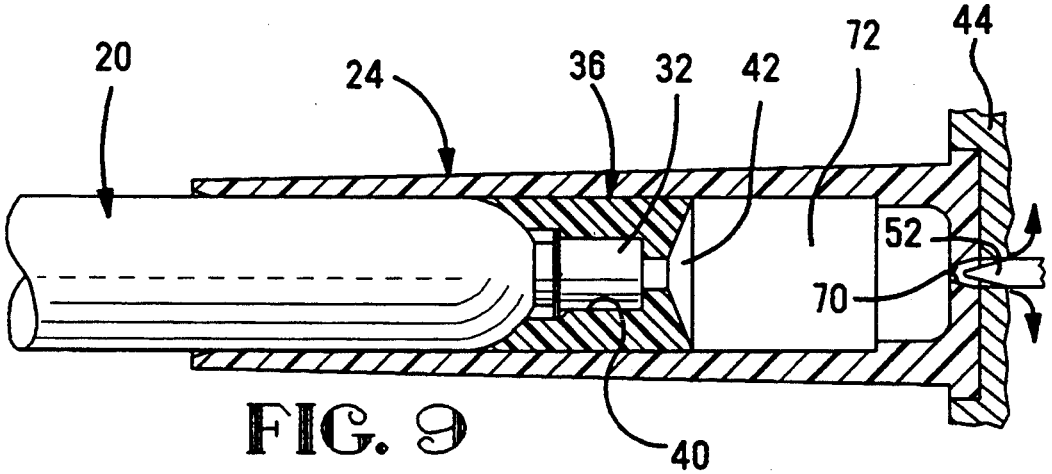

At this point in the operation of the tool 10, there is a residual amount of gas 72 remaining in the cartridge, as best seen in FIG. 8. Note that the gas check member 36 has been driven forward within the cartridge along with the ram 20. The heat generated by the discharge has caused the outer walls of the gas check member to fuse with the inner walls of the cartridge. The residual gas 72 exerts pressure within the cavity of the cartridge but cannot escape because the gas check and primer are forced against one end of the ram 20 while the other end of the ram is forced against the work piece. Additionally, the residual gas 58 exerts pressure against the inside of the base 62 tending to urge the plastic of the base against the tapered walls of the tip 52. This residual gas 72 is released by partially unscrewing the knurled member 48 so that the piercer pin 46 is moved away from the cartridge thereby opening up the opening in the base formed by the piercer pin. The residual gases then flow past the piercer pin, as shown in FIG. 9, through vent holes 68 in the knurled member 48, as shown in FIG. 2, and into the atmosphere. At this point, as shown in FIG. 9, the residual gas 72 is at atmospheric pressure. After venting the residual gas, the work piece is removed, the expended shell is removed and a fresh cartridge installed, another work piece is inserted into the tool 10, and the process repeated.

Figure 6:
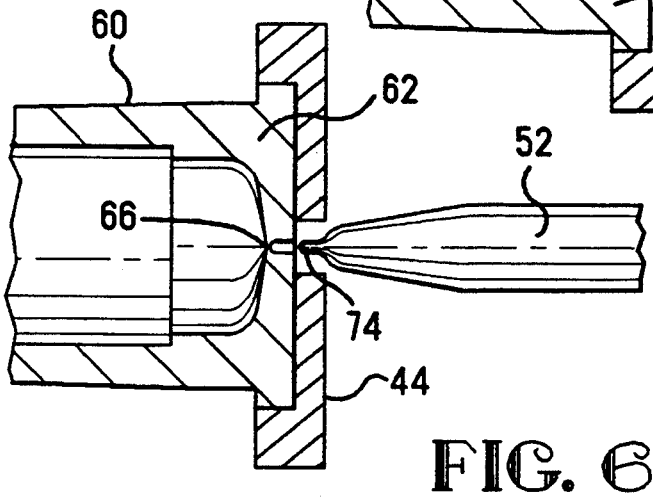
FIG. 6 is a view similar to that of FIG. 5 showing a broken piercer pin.

Occasionally, the tip 52 of the piercer pin 46 becomes severely worn or broken, as indicated by 74 in FIG. 6, so that when the knurled member 48 is screwed fully into the sleeve 30, the tip 52 does not penetrate sufficiently far into the depression 64 to pierce through the thin section 66. When this occurs, upon firing of the cartridge, the forces of the exploding powder 38 cause the thin section 66 to fracture thereby allowing the expanding gasses to escape through the fracture, past the piercer pin, and into the vent holes 68. This provides a distinct audible warning to the operator that the piercer pin is defective and should be replaced.

While the depression 64, in the present example is shown in the base 62 on the longitudinal axis of the cartridge, the teachings of the present invention may be practiced by positioning the depression on a side of the cartridge away from the base as long as the thin section 66 is adjacent the interior portion of the cartridge containing the residual gases 72, and the piercer pin 46 is arranged in alignment with the depression. It will be understood, however, that the prefered position is in the base 62. Further, the thin section 66 may be either on an inside surface of the shell 60 or on an outside surface thereof, although, it is preferably on an inside surface.

An important advantage of the present invention is that the tool will not remain pressurized after firing if the piercer pin is badly worn or broken thereby obviating the difficulty encountered in opening a pressurized tool. Additionally, the operator is provided with a distinct audible indication that gases are being vented prematurely due to a defective piercer pin.

I claim:

1. A cartridge for use in an explosively operated industrial tool having a body with a chamber therein for receiving said cartridge and a breach cap fitted over said body enclosing one end of said chamber, said breach cap having a piercer pin projecting therefrom into said chamber for moving into engagement with and piercing through an end of said cartridge to release gases contained therein, said cartridge comprising:

(a) an elongated shell open at one end and having a base at the opposite end;

(b) a gas check positioned in said shell between said open end and said base, said gas check containing a primer;

(c) explosive powder, ignitable by said primer, contained in a powder chamber within said shell between said gas check and said base: and (d) a depression in a surface of said base of said cartridge forming a relatively thin section therein adjacent to and in alignment with said piercer pin and arranged so that when said piercer pin is moved into said engagement with said base and only when said piercer pin does not pierce completely through said thin section, said thin section will fracture upon ignition of said explosive powder allowing expanding gases to escape through the fracture.

2. The cartridge according to claim 1 wherein said depression is up to about 0.100 inch wide and said thin section has a thickness of from about 0.003 inch to about 0.025 inch.

3. The cartridge according to claim 2 wherein said depression is about 0.028 inch wide and said thin section is from about 0.005 inch to about 0.015 inch.

4. The cartridge according to claim 1 wherein said depression is formed in a surface of said base that is inside of said powder chamber.

5. The cartridge according to claim 1 wherein said depression is formed in a surface of said base that is outside of said powder chamber.

6. The cartridge according to claim 5 wherein said depression is arranged so that when said piercer pin is in said engagement with base, at least a portion of said pin is within said depression.

7. The cartridge according to claim 1 wherein said cartridge has a longitudinal axis and said depression is arranged on said axis.

8. The combination of a cartridge containing explosive powder and a primer for ignition thereof and an explosively operated industrial tool having a body with a chamber therein receiving said cartridge and a breach cap fitted over said body enclosing one end of said chamber, an other end of said chamber having a ram, operable upon ignition of said explosive powder to perform a desired work operation, said breach cap having a piercer pin projecting therefrom into said chamber for moving into engagement with and piercing through a surface of said cartridge adjacent said explosive powder to release gases contained therein, said surface of said cartridge having a depression forming a relatively thin section therein adjacent to and in alignment with said piercer pin and arranged so that when said piercer pin is moved into said engagement with said surface and only when said piercer pin does not pierce completely through said thin section, said thin section will fracture upon said ignition of said explosive powder allowing expanding gases to escape through the fracture.

9. The combination according to claim 8 wherein said depression is arranged so that when said piercer pin is in said engagement with said surface at least a portion of said pin is within said depression.

10. The combination according to claim 9 wherein said depression is in a base on the longitudinal axis of said cartridge.

11. The combination according to claim 10 wherein said depression is about 0.028 inch wide and said thin section is from about 0.005 inch to about 0.015 inch.

* * * * *